United States Patent [19]

Hurter

[11] Patent Number: 4,554,521

[45] Date of Patent: Nov. 19, 1985

[54] ARMATURE/CONTACT SYSTEM

[75] Inventor: Max Hurter, Riverside, Calif.

[73] Assignee: Babcock Electro-Mechanical, Inc., Costa Mesa, Calif.

[21] Appl. No.: 627,436

[22] Filed: Jul. 3, 1984

[51] Int. Cl.[4] ..... H01H 67/06

[52] U.S. Cl. ..... 335/125; 335/128; 335/133

[58] Field of Search ..... 335/124, 125, 128, 129, 335/133, 276

[56] References Cited

U.S. PATENT DOCUMENTS

| | | | |
|---|---|---|---|
| 3,161,744 | 12/1964 | Thorne et al. | 335/81 |
| 3,178,532 | 4/1965 | Smith | 335/125 |
| 4,604,260 | 1/1977 | Happach | 335/128 |

*Primary Examiner*—George Harris

*Attorney, Agent, or Firm*—Harvey C. Nienow

[57] ABSTRACT

An armature/contact system wherein the armature rotates about a given axis, and a contactor is mounted thereon for movement therewith. The contactor is so formed as to have a resilient member having a contact surface which is within a plane which includes the axis of rotation of the armature. A stationary contact is provided for engagement by such contactor, such stationary contact having an arcuate contact surface. Limit-stop means is provided for defining the position of the contactor surface within a plane which intersects the axis of the armature whenever the contactor surface and stationary contact surface are out of engagement with each other.

12 Claims, 4 Drawing Figures

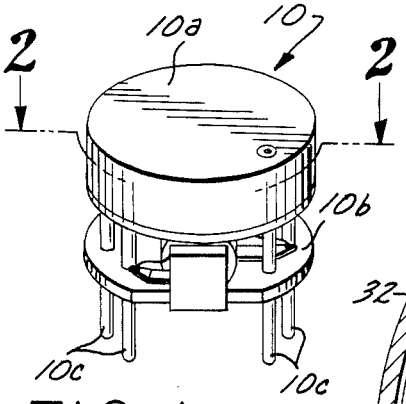
FIG. 1
FIG. 2
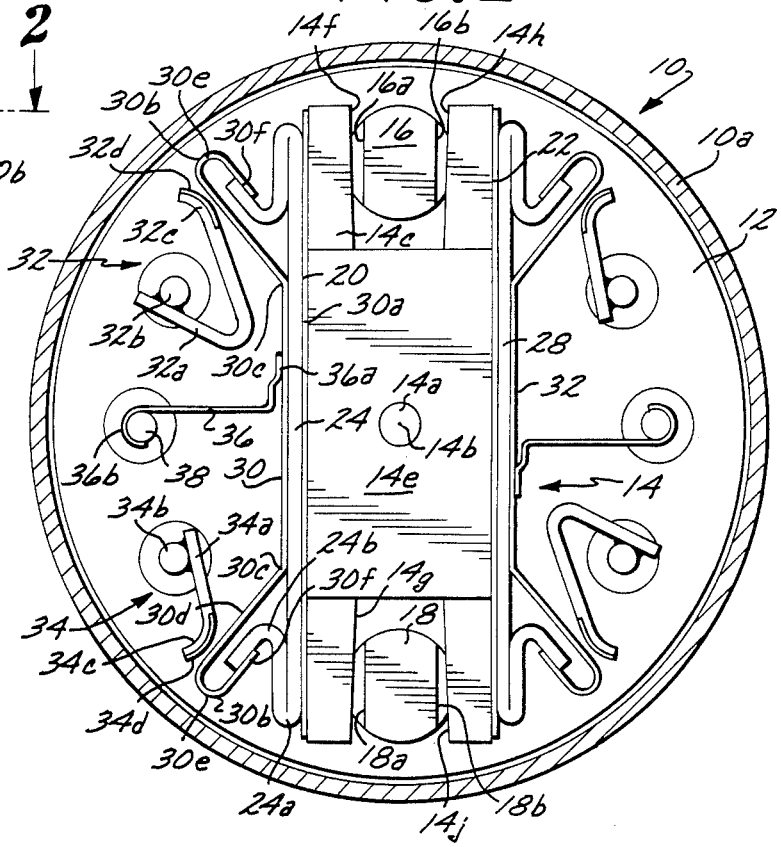
FIG. 3
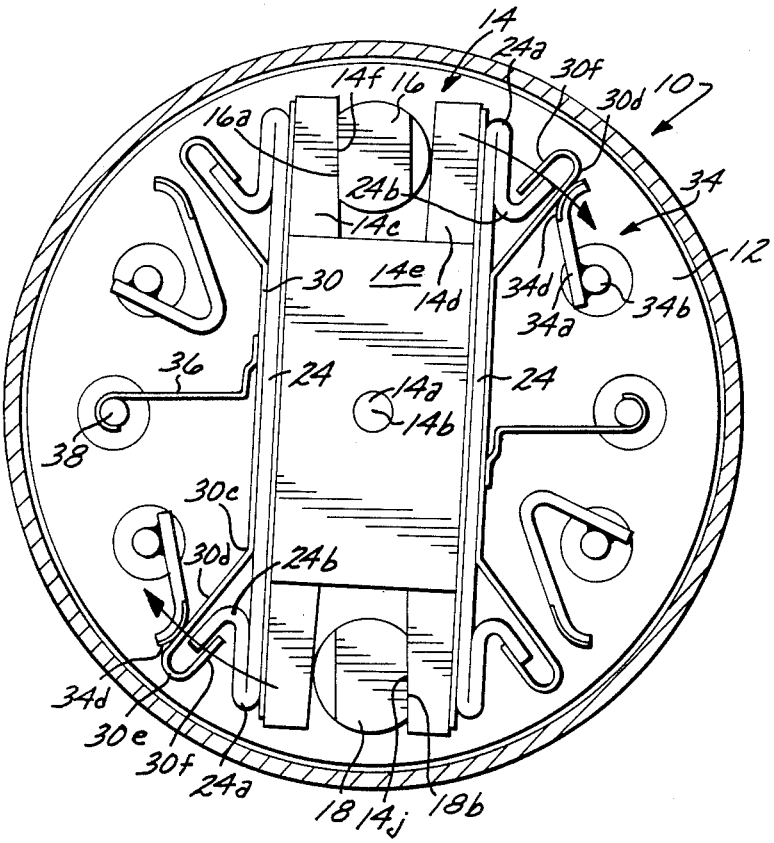
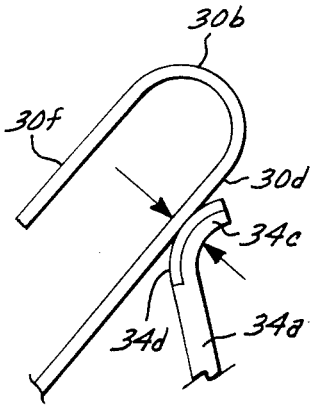
FIG. 4

ARMATURE/CONTACT SYSTEM

The present invention relates generally to armature/-contact systems for electromagnetic switches and the like, but more particularly to such systems wherein frictional forces between moveable and stationary contact surfaces are greatly reduced.

BACKGROUND OF THE INVENTION

For some applications of electrical switches it is desirable to minimize, if not eliminate entirely, wiping, frictional engagement between electrical contacts. Since such frictional forces, as are found in prior designs, have required a considerable amount of energy from the electromagnetic motor or other actuating means, it is desirable to eliminate such friction so as to more efficiently utilize the electromagnetic motor or other actuating means. That is, by eliminating the need for such additional electromagnetic force, a smaller, more compact and highly efficient relay can be provided. The reduced size, of course, without sacrificing the primary objective of effectively controlling the continuity of an electrical circuit, is particularly desirable in many different space applications wherein space is a prime consideration.

OBJECTS OF THE INVENTION

It is an object of the present invention to provide an armature/contact system for use in controlling the continuity of an electrical circuit, such that minimum frictional forces occur between the stationary and moveable contacts.

Another object of the present invention is to provide an armature/contact system as characterized above where in most, if not all wiping action between the contacts has been eliminated.

Another object of the present invention is to provide an armature/contact system as characterized above wherein the moveable contact surface is within a plane which includes the axis of rotation of the armature.

An even further object of the present invention is to provide an armature/contact system as characterized above wherein the stationary contact is formed with an arcuate contact surface to insure that the moveable contact has engagement therewith substantially along a line such that the contact forces are substantially at right angles to the plane of the moveable contactor surface.

Another even further object of the present invention is to provide an armature/contact assembly as characterized above wherein the moveable contactor is flexible such that the moveable contactor resiliently flexes after initial contact with the stationary contact surface and throughout continued overtravel of the former.

A still further object of the present invention is to provide an armature/contact assembly as characterized above wherein limit-stop means is provided for defining the position of the moveable contactor within a plane which includes the axis of rotation of the armature, following separation of the moveable and stationary contacts.

An even still further object of the present invention is to provide an armature/contact assembly as characterized above which is simple and inexpensive to manufacture and which is rugged and dependable in operation.

BRIEF DESCRIPTION OF THE DRAWINGS

The novel features which I consider characteristic of my invention are set forth with particularity in the appended claims. The invention itself, however, both as to its organization and mode of operation, together with additional objects and advantages thereof, will best be understood from the following description of specific embodiments when read in connection with the accompanying drawings, in which:

FIG. 1 is a perspective view of a relay which might be constructed with an armature/contact assembly according to the present invention;

FIG. 2 is a sectional view of the relay of FIG. 1, taken substantially along line 2—2 of FIG. 1 of the drawings;

FIG. 3 is a view similar to FIG. 2 showing the armature and contacts in different positions; and FIG. 4 is a fragmentary elevational view of engagement of a contactor with a stationary contact.

Like reference characters indicate corresponding parts throughout the several views of the drawings.

DESCRIPTION OF THE PREFERRED EMBODIMENT

Referring to FIG. 1 of the drawings, there is shown therein an electromagnetic relay 10 which may be adapted with an armature/contact assembly or system according to the present invention. As will be hereinafter readily apparent to those persons skilled in the art, the present invention is adaptable for inclusion in substantially any type of electrical switch, whether it be manually operated or electroresponsive. The design of the contacts and their relationship to the armature or actuator of a switch might vary from one switch to another, but the invention is described herein as it is related to an electromagnetic relay 10 wherein there is a pivotal armature 12, as shown most clearly in FIGS. 2 and 3 of the drawings.

Relay 10 comprises a housing 10*a* wherein is mounted an armature/contact assembly or system such that, as the armature is moved from one position to another, the electrical contacts are opened or closed, as the case may be.

Also forming part of the relay 10 is a mounting platform 10*b* which carries an electromagnetic motor having an electromagnetic circuit for conducting electromagnetic energy to the armature within housing 10*a*. Relay 10 further comprises suitable terminal pins, as shown at 10*c*, for connecting the electromagnetic motor to a source of power, and for connecting the circuit or circuits to be controlled to the various electrical contacts within housing 10*a*, as will be readily apparent to those persons skilled in the art.

Referring to FIGS. 2 and 3 of the drawings, it is seen that housing 10*a* includes a partition wall 12 whereon is pivotally mounted an armature 14. Armature 14 includes a pivot pin 14*a* one end of which is mounted within a suitable opening in partition wall 12, and the opposite end of which is mounted in a suitable opening in a bridge member (not shown), to thereby enable armature 14 to pivot about the axis 14*b* of pin 14*a*.

Although armature 14 can be constructed in substantially any manner desired, the armature shown in FIGS. 2 and 3 comprises a pair of magnetically permeable arms 14*c* and 14*d* which are secured in fixed spaced relation to each other by means of a pair of bearing plates, one of which is shown at 14*e*.

As is readily apparent from FIGS. 2 and 3, the armature 14 shown in the drawing is double-acting so that the magnetically permeable arms 14*c* and 14*d* are formed with opposite pole faces, as shown at 14*f* and 14*g*, with respect to member 14*c*, and as shown at 14*h* and 14*j*, with respect to member 14*d*. Pole faces 14*f* and 14*h* cooperate with a magnetic pole member 16, and the pole faces 14*g* and 14*j* cooperate with a pole member 18, the members 16 and 18 being part of the magnetic circuit, as will be readily apparent to those persons skilled in the art.

Pole member 16 is formed with pole faces 16*a* and 16*b*, which cooperate with pole faces 14*f* and 14*h*, respectively. In like manner, pole member 18 is formed with pole faces 18*a* and 18*b* for cooperation with pole faces 14*g* and 14*j*, respectively.

Fixed to the opposite sides of armature 14 are insulators 20 and 22 which carry members 24 and 28, respectively.

Positioned on member 24 is a contactor 30, and positioned on member 28 is a contactor 32. Such contactors are identical in construction as are the members 24 and 28, and therefore, only member 24 and contactor 30 will be described in detail, it being realized that member 28 and contactor 32 are thereby readily apparent to those persons skilled in the art. It is contemplated, as set forth in the claims hereinafter, that the subject invention pertains to an armature/contact system which causes engagement and disengagement of a single pair of cooperating electrical contacts. The more elaborate system disclosed herein is not mandatory for successful operation of this invention.

Contactor 30 is formed with an intermediate portion 30*a* and a moveable contact 30*b* at each end. Contactor 30 is formed with a pair of offsets, as at 30*c*, to provide a moveable contactor surface 30*d* which is coplanar and is within a plane which includes the axis of rotation 14*b* for armature 14. Each of the marginal opposite ends of contactor 30 are reversely bent, as at 30*e* to provide an extension 30*f*.

The opposite ends of member 24 are bent or folded back on themselves, as at 24*a*, and are provided with a bend as shown at 24*b*.

Extension 30*f* and end 24*b* of member 24 cooperate to provide a limit stop for defining the position of moveable contactor surface 30*d*, as will hereinafter be explained in greater detail.

For cooperation with each of the contact surfaces of the contactor, there is provided a stationary contact. Stationary contact 32 comprises a V-shaped member 32*a* welded to a terminal post or mounting pin 32*b* which, as will be readily apparent to those persons skilled in the art, becomes one of the terminal pins 10*c* hereinabove mentioned. Stationary contact 32 further comprises a contact portion 32*c* which is arcuate in form and is provided with an arcuate contact surface 32*d*. The curvature of the arcuate surface 32*d* is such, with respect to the member 32*a* that, as arcuate surface 32*d* is engaged by the moveable contact surface 30*d*, line contact is maintained therebetween and the contact force thus generated is at substantially right angles to the aforementioned plane of the moveable contactor surface 30*d*.

Stationary contact structure 34 is another embodiment of the present invention, and comprises an arm or member 34*a* which is attached to mounting post 34*b* as by welding, brazing, soldering or the like. Member 34*a* is formed with an arcuate end portion 34*c*, having an arcuate contact surface 34*d*.

As shown with respect to stationary contacts 32 and 34, each of the arcuate surfaces 32*d* and 34*d*, respectively, may be provided with a highly conductive insert formed of gold or the like so that the electrical conductivity between the moveable and stationary contacts is extremely good.

To enable the moveable contactor 30 to be connected to an appropriate electrical circuit, a connector 36 is firmly secured to contactor 30 as at end portion 36*a*, the opposite end 36*b* of connector 36 being attached to a terminal post 38 which may be one of the aforementioned terminal pins 10*c*.

The material of which connector 36 is made is such that it is extremely flexible and, under flexure during rotation of armature 14, offers substantially no mechanical or physical resistant to bending.

In operation, upon rotation of the armature 14 under the influence of electromagnetic flux at pole members 16 and 18, the armature causes one or more of the moveable contacts to be moved into or out of engagement with one or more stationary contacts. As shown in FIG. 3, rotation of armature 14 in clockwisedirection causes engagement of moveable contacts with stationary contacts in the upper right and lower left quadrants of the drawings. Due to the fact that the contactor surfaces of such moveable contacts are within a plane which includes the axis of rotation 14*b* of the armature 14, the contact force thereby developed is at substantially right angles to such plane and to the contact surfaces of the thus mating moveable and stationary contacts. This insures that there is virtually no wiping action or frictional forces encountered in such contact.

As such engagement continues, the corresponding moveable contact 30*b* is caused to flex. This, together with the arcuate surface 34*d* of the respective stationary contacts causes substantially no frictional forces to be generated between the stationary and moveable contacts during such continued overtravel.

In like manner, if the armature is caused to move in a counterclockwise direction, the same results obtain from engagement of the moveable contactor surfaces 30*d* with the respective stationary contact 32 shown in the upper left and lower right hand quadrants of the drawings. Again, however, due to the position of the contactor surface within a plane which includes the axis of rotation of the armature, as well as the arcuate contact surface of the stationary contacts, only minimum frictional forces are developed.

Whenever the armature is pivoted such as to open or separate a pair of contacts, the extension 30*f* of the respective contactor end portion engages the respective stop member 24*b* so as to thereby return the corresponding contactor surface to the plane which includes the axis of rotation of the armature.

Although I have shown and described certain specific embodiments of my invention, I am well aware that many modifications thereof are possible. The invention, therefore, is not to be restricted except insofar as is necessitated by the prior art and by the spirit of the appended claims.

I claim:

1. An armature/contact system for controlling the continuity of an electrical circuit, comprising in combination, a pivotal armature adapted to move about a given axis, a resilient (moveable) contactor carried by such armature (and) having a contactor surface and an axis of flexure relative to said armature which are within a plane which includes said pivotal axis for said armature, and a stationary contact positioned relative to said armature and having an arcuate surface to be engaged by said contactor at said contactor surface upon pivotal movement of said armature.

2. An armature/contact system for controlling the continuity of an electrical circuit according to claim 1 wherein said contactor is formed of resilient material for movement relative to said armature following engagement of the surfaces of said contactor and stationary contact.

3. An armature/contact system for controlling the continuity of an electrical circuit according to claim 2 wherein said contactor is formed with limit-stop means for defining the limit of return movement of said contactor following separation of said contactor and stationary contact.

4. An armature/contact system for controlling the continuity of an electrical circuit according to claim 3 wherein said stationary contact comprises a member for retaining said stationary contact in a fixed position relative to said contactor upon movement of said armature following engagement of said contactor and stationary contact surfaces.

5. An armature/contact system for controlling the continuity of an electrical circuit according to claim 4 wherein said arcuate surface of said stationary contact is so formed relative to said contactor that as the latter flexes under the force of said armature, the arcuate surface of said stationary contact presents to said contactor a point of contact which is substantially at right angles to the contactor surface throughout said overtravel.

6. An armature/contact system for controlling the continuity of an electrical circuit according to claim 5 wherein said contactor is formed with a reversely bent end portion engageable with a stop member to provide the limit stop for defining the return travel of said contactor relative to said armature.

7. An armature/contact system for controlling the continuity of an electrical circuit according to claim (7) 6 wherein two or more contactor surfaces are provided on said armature for engagement individually with separate stationary contacts, each of said contactor surfaces and axis of flexure being within a plane which includes said axis.

8. An armature/contact system for controlling the continuity of an electrical circuit according to claim 7 wherein said contactor is formed with said two or more contactor surfaces.

9. An armature/contact system for controlling the continuity of an electrical circuit according to claim 8 wherein said contactor is formed with an intermediate portion and opposite end portions, the latter of which are individually formed into said contactor surfaces in separate planes which include said axis.

10. An armature/contact system for controlling the continuity of an electrical circuit according to claim 9 wherein the marginal portions of said end portions are individually reversely bent for engagement with individual limit stops.

11. An armature/contact system for controlling the continuity of an electrical circuit according to claim 10 wherein the armature is formed with at least one armature pole to be magnetically attracted to a stationary pole to effect rotation of said armature.

12. An armature/contact system for controlling the continuity of an electrical circuit according to claim 11 wherein the arcuate surface of each stationary contact is formed with a surface of high electrical conductivity material.

* * * * *